US009562441B2

(12) United States Patent
Breugnot et al.

(10) Patent No.: US 9,562,441 B2
(45) Date of Patent: Feb. 7, 2017

(54) TURBO MACHINE WITH A DEVICE FOR PREVENTING A SEGMENT OF NOZZLE GUIDE VANES ASSEMBLY FROM ROTATING IN A CASING; ROTATION-PROOFING PEG

(75) Inventors: Thierry Michel Breugnot, Nangis (FR); Didier Noel Durand, Pontault Combault (FR); Florence Irene Noelle Leutard, Samoreau (FR)

(73) Assignee: SNECMA, Paris (FR)

( * ) Notice: Subject to any disclaimer, the term of this patent is extended or adjusted under 35 U.S.C. 154(b) by 1006 days.

(21) Appl. No.: 13/700,641

(22) PCT Filed: May 31, 2011

(86) PCT No.: PCT/FR2011/051251

§ 371 (c)(1),
(2), (4) Date: Nov. 28, 2012

(87) PCT Pub. No.: WO2011/151596

PCT Pub. Date: Dec. 8, 2011

(65) Prior Publication Data

US 2013/0078086 A1 Mar. 28, 2013

(30) Foreign Application Priority Data

Jun. 1, 2010 (FR) ..... 10 54263

(51) Int. Cl.
*F01D 25/08* (2006.01)
*F01D 25/24* (2006.01)

(52) U.S. Cl.
CPC ..... *F01D 25/08* (2013.01); *F01D 25/246* (2013.01); *F05D 2230/64* (2013.01);
(Continued)

(58) Field of Classification Search
CPC ..... F01D 25/24; F01D 25/246; F01D 9/02; F01D 9/04; F01D 9/042
See application file for complete search history.

(56) References Cited

U.S. PATENT DOCUMENTS 5,201,846 A 4/1993 Sweeney
5,775,874 A 7/1998 Boite et al.

FOREIGN PATENT DOCUMENTS

DE 199 59 665 6/2001
DE 19959665 A1 * 6/2001
(Continued)

OTHER PUBLICATIONS

English Translation of DE19959665A1.*
International Search Report Issued Oct. 24, 2011 in PCT/FR11/051251 Filed May 31, 2011.

*Primary Examiner* — Eric Keasel
*Assistant Examiner* — Cameron Corday
(74) *Attorney, Agent, or Firm* — Oblon, McClelland, Maier & Neustadt, L.L.P.

(57) ABSTRACT

A device for preventing rotation of a segment of nozzle guide vanes assembly in a form of an annulus sector housed inside an annular casing of a turbo machine with interposing of a heat shield sheet between an internal wall of the casing and an external wall of the segment of nozzle guide vanes assembly, the device including a rotation-proofing peg fitted both into a notch formed in the segment of nozzle guide vanes assembly and in a housing formed in the casing, the heat shield sheet including a tab resting against the rotation-proofing peg. A surface portion radially between the tab and the internal wall of the casing forms an end stop in event of a possible radial movement of the heat shield sheet while the turbo machine is in operation.

11 Claims, 3 Drawing Sheets

(52) U.S. Cl.
CPC .... *F05D 2230/642* (2013.01); *F05D 2240/11* (2013.01); *F05D 2250/70* (2013.01); *F05D 2260/30* (2013.01); *F05D 2260/94* (2013.01); *F05D 2260/941* (2013.01)

(56) References Cited

FOREIGN PATENT DOCUMENTS

| | | | |
|---|---|---|---|
| DE | 100 48 156 | | 4/2002 |
| EP | 1 462 616 | | 9/2004 |
| EP | 1462616 | A2 * | 9/2004 |
| GB | 2 239 678 | | 7/1991 |
| GB | 2 309 053 | | 7/1997 |

* cited by examiner

TURBO MACHINE WITH A DEVICE FOR PREVENTING A SEGMENT OF NOZZLE GUIDE VANES ASSEMBLY FROM ROTATING IN A CASING; ROTATION-PROOFING PEG

The present invention concerns the area of turbo machines and looks at an axial turbine ring distributor formed by distributor segments which are arranged in ring sectors. More particularly, the invention concerns a device for preventing said sectors from rotating inside the casing.

BACKGROUND TO THE INVENTION

A gas turbine engine such as used in aeronautics includes an upstream inlet through which air is sucked in and then compressed by being guided through the compressor stages. The compressed air is introduced into a combustion chamber, the fuel also being admitted into said combustion chamber and mixed with the air and combustion taking place in said chamber. The hot combustion gases are expanded in the different turbine stages, one of which is generally a high pressure stage directly downstream of the chamber and which receives the gases at the highest temperature compatible with the behavior of the materials. After said first expansion, the gases are expanded again by being guided through the so-called low pressure turbine stages. One turbine stage includes a wheel of distributors upstream of a turbine runner.

A distributor wheel with axial flow includes a plurality of blades arranged radially with regard to the axis of the machine connecting a ring-shaped element radially inside and a ring-shaped element radially outside; the assembly forms a ring-shaped vein facing the runner blades of a turbine wheel. The runner is itself made up of blades which extend radially from the rim of a disk or a moving drum about a rotational axis. The blades are traversed in an axial manner by the engine gases. In this way, the low pressure section of an engine generally includes several turbine stages.

The distributor wheels are segmented into a plurality of sectors which are distributed around the axis of the machine, each segment being formed by a plurality of blades between two ring sectors. Each segment is mounted inside the casing of the turbine by the ring sector radially outside. Said latter includes a retaining means upstream and a retaining means downstream. Said means, for example, are ring-shaped rails which are provided in the inside wall of the casing on which support surfaces, which are arranged on the ring sectors of the distributor segments, come to bear. The assembly is arranged so as to allow the relative expansion of the distributor with regard to the casing which is a function of the variations of the working of the machine. On account of the axial symmetry of the distributor wheels and of the tangential stresses resulting from the gaseous flow which traverses them, it is necessary to provide means for blocking the sectors from rotating.

Patent FR 2 743 603 in the name of SNECMA describes a method of assembling such distributor segments inside a casing. The distributor segments include a peripheral outside rib, at right angles to the axis of the distributor, resting by way of faces, one radially outside, the other downstream, on corresponding faces of the inside wall of the casing. Clamps, formed by the turbine ring downstream of said level, hold the segments and keep them in position against the radial movements. A protrusion on the upstream face of the rib of each segment includes a notch in which a rotation-proofing peg is housed. Said peg is made up by a head which is housed in said notch and a rod which is slid into a radial bore of the wall of the casing. In this way, said peg prevents any rotational movement of the distributor segment about the axis of said latter.

So as to protect the wall of the casing against radiant heat produced by the distributor segments, a sheet is provided interposed between the segment and the inside wall of the casing. Said heat shield sheet bears upstream against a radial surface portion which is arranged in the inside wall of the casing. The upstream edge of the shield sheet is curved radially toward the inside in order to form a pin which also bears on an upstream edge of the segment and participates in the holding of said segment against the upstream rail of the casing. Downstream the shield sheet includes an indentation with a tab in the bottom of the indentation which bears against the rotation-proofing peg of the segment. The tab is in effect wedged in a fine groove of the peg.

Said assembly provides complete satisfaction as regards holding the distributor inside the casing and protecting it thermally.

However, it has been observed that the sheet was likely to release itself from its contact with the rotation-proofing peg, the tab coming out of the bearing groove provided on the peg. By not being retained against the peg, the downstream part of the sheet, where the tab is located, is able to go and rub against the inside face of the wall of the casing, and scratch the same. It would be desirable to eliminate said risk of wear on the casing.

OBJECT OF THE INVENTION

The object of the present invention is to alleviate said problem.

According to the invention, said problem is resolved with a turbo machine which is provided with a device for preventing the rotation of a distributor segment in the form of a ring sector which is housed inside a ring-shaped casing of the turbo machine, with the interposing of a heat shield sheet between the inside wall of the casing and the outside wall of the segment, including a rotation-proofing peg which is mounted both in a notch arranged on the segment and a housing arranged on the casing, the heat shield sheet including a tab bearing against the rotation-proofing peg. The turbo machine is characterized by the fact that the device includes the arranging of a surface portion radially between the tab and said inside wall of the casing, forming an abutment in the event of possible radial displacement of the heat shield sheet during the operation of the turbo machine.

By interposing an abutment between the casing and the part of the sheet likely to move during the operation of the machine, the risk of contacting the inside wall of the casing is thus eliminated.

According to one embodiment, the peg includes a head which is housed in the notch of the segment and a rod entering the housing which is arranged on the casing, said surface portion being integral with the head of the rotation-proofing peg.

The advantage of said embodiment is that it only concerns the rotation-proofing peg, the remaining parts: the distributor segment, the heat shield sheet and the casing remaining unchanged. An important economic advantage follows, it being possible to replace the existing peg by the modified peg without modifying the surrounding parts.

Said replacement can be carried out from new for preventive purposes or on the occasion of a repair.

In an advantageous manner, the said surface portion is made up by a shoulder machined in the head of the rotation-proofing peg; more particularly said surface portion is formed by a lug which extends parallel to the axis of the distributor and bears against the inside wall of the casing.

The device of the invention has an interesting application in the configuration described in patent FR 2 743 603, the distributor segment including a rib, at right angles to the axis of the distributor, bearing against the inside wall of the casing, and said notch of which is formed in a protrusion which is provided on one side of the rib. In this case, the heat shield sheet is preferably in the form of a ring sector with an indentation corresponding to said protrusion, the tab being arranged in the bottom of the indentation. More particularly, the shield sheet is provided upstream with regard to the rib of the distributor segment and the rotation-proofing peg.

Insofar as the characteristic of the invention concerns just the rotation-proofing peg, the invention also concerns a rotation-proofing peg capable of being used in the device above, the peg including a straight rod and a head with a first face parallel to the axis of the rod and a surface portion at right angles with respect to said first face, on the side opposite the rod.

In a preferable manner, the peg includes a lug at right angles with respect to the axis of the straight rod, said surface portion being arranged on the lug.

The invention also concerns a gas turbine engine including a turbine stage with a device such as described above.

BRIEF DESCRIPTION OF THE FIGURES

The invention will now be described by way of the following accompanying figures which are for illustrative purposes and are not restrictive, in which.

DESCRIPTION OF AN EMBODIMENT

Figure 1:
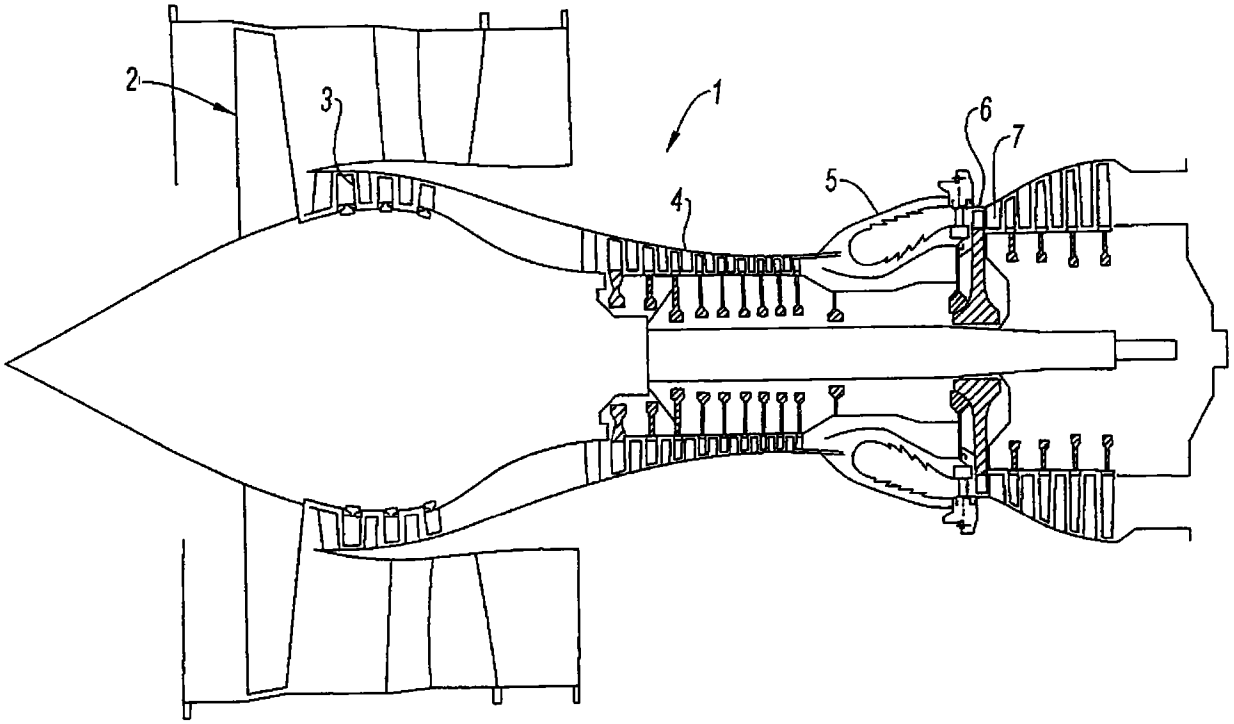
FIG. 1 shows an example of a gas turbine engine on which the invention is applied.

With reference to FIG. 1, an axial section of a turbo blower type gas turbine engine 1 can be seen. It includes from upstream to downstream, here from left to right, a blower 2 with a low pressure compressor 3, a high pressure compressor 4, a combustion chamber 5, a high pressure turbine 6 and a low pressure turbine 7. By means of a central shaft, the low pressure turbine 7, which includes several moving stages on one same rotor, drives the assembly which is formed by the blower 2 and the low pressure compressor 3. The high pressure turbine 6 in one single stage drives the high pressure compressor 4 in an independent manner.

Figure 2:
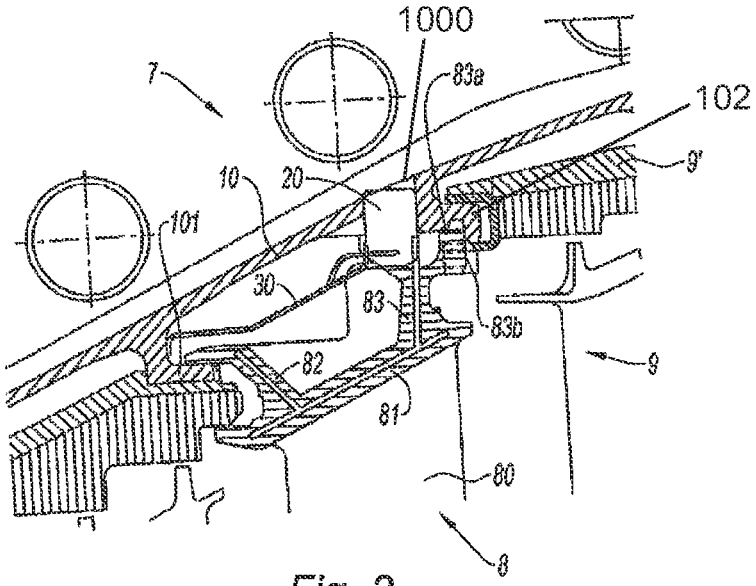
Fig. 2 Background Art
FIG. 2 shows a part view in axial section of a turbine distributor mounted in the casing of a gas turbine engine according to the prior art.

FIG. 2 shows a part view of the section of the low pressure turbine 7 at the level of its outer circumference. A distributor 8 or stator is upstream of a wheel with runner blades 9 inside the casing 10 of the turbine. The runner turns about the axis of the machine inside a turbine ring 9'.

The distributor 8 is formed by fixed blades which are arranged in a wheel divided into a plurality of segments 80 which are distributed circumferentially around the axis of the machine. Each segment 80 includes several adjacent fixed blades which are integral with an element in the ring sector 81. The distributor segment 80 is held upstream by a rib in the form of a rail 101 which extends axially from the inside wall of the casing 10; an upstream hook 82, which is integral with the element in the ring sector 81, bears against the radially outer face of the rail 101. Downstream the element 81 includes a peripheral radial rib 83, at right angles to the axis of the distributor, which rests by way of a radially outside face 83*a* and a downstream face 83*b* on the corresponding faces of a ring-shaped rail 102 which extends axially from the inside wall of the casing 10 with a downstream edge turned toward the axis.

Figure 3:
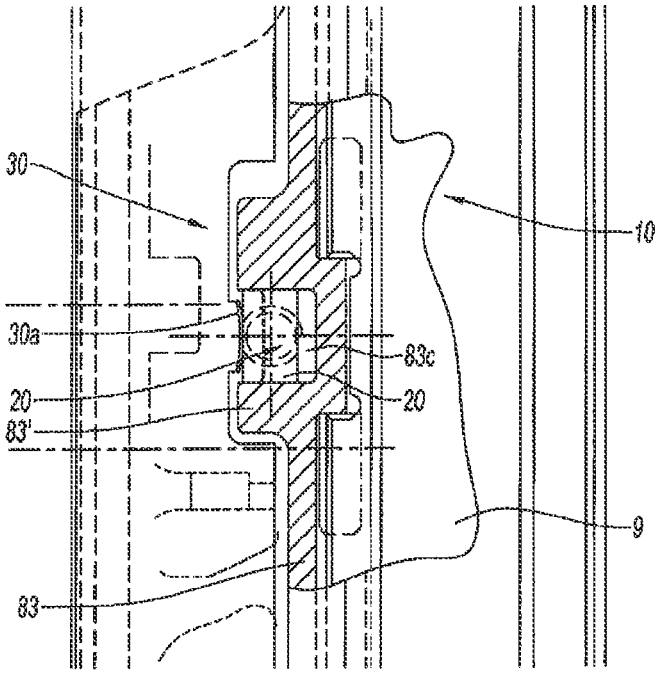
Fig. 3 Background Art
FIG. 3 is a view toward the axis of the engine of the distributor of FIG. 2 with a part cut away.

As can also be seen in FIG. 3, a rotation-proofing peg 20 is housed in a radial bore 1000 of the casing 10. The peg 20 juts out from the inside of the casing and is housed in a notch 83*c* which is machined in the rib 83 of the segment 80. It must be noted that at this level the rib forms an overthickness 83' in which the notch is machined. As is stated in patent FR 2 743 603, the rib 83 forms a barrier to the gases which are located upstream; there is no communication between the zone situated upstream of the rib 83 and the zone situated downstream. The peg is adjusted tightly in the bore of the casing but also in the notch 83*c*. It comprises two flanks 22*a* and 22*b* which are slid between the flanks of the notch which are machined parallel to the axis of the distributor. The notch is open upstream and is situated in the center of the segment. In this way, the segment 80 is held fixed against rotation with regard to the casing, whilst being able to expand circumferentially on both sides of the peg and to move axially to a certain extent.

A heat shield sheet 30 is arranged between the ring sector 81 of the segment 80 and the inside wall of the casing. The sheet has the general form of a ring sector which upstream bears against an abutment surface arranged in the casing which can be at the level of the upstream rail 101. Downstream the shield sheet 30 is cut away into an indentation which follows the contour of the protrusion 83' of the rib. A tab 30*a* in the bottom of the indentation bears against the rotation-proofing peg 20. As the sheet is lightly deformable, a spring effect can be provided in order to ensure the sheet is held in position during the operation of the turbo machine.

Figure 4:
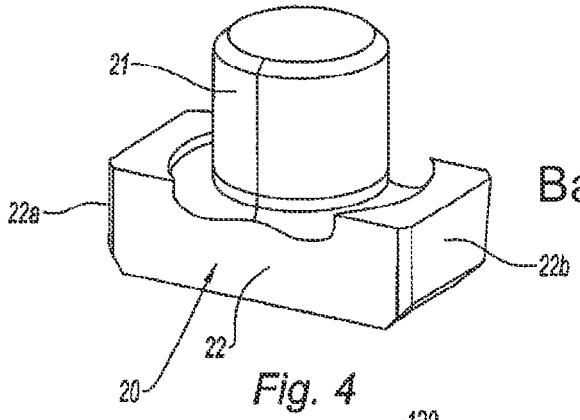
Background Art Fig. 4
FIG. 4 shows the rotation-proofing peg of the prior art.

FIG. 4 shows the rotation-proofing peg of the prior art. It comprises a cylindrical rod 21, the diameter of which allows for tight adjustment in the bore of the casing. The peg includes a head 22 forming the bar of a T with the rod 21. Said head is parallelepipedic in form with two flanks 22*a* and 22*b* which are parallel to the axis of the rod 21 and between them. The tab 30*a* of the shield sheet comes to bear against the face, at right angles to the two first flanks 22*a* and 22*b*, provided upstream when the peg is in the notch 83*c* of the rib 83.

It has been shown that this has not been sufficient and that the downstream edge of the shield sheet was likely to go and rub against the inside face of the casing, possibly resulting in the forming of unwanted grooves.

The rotation-proofing peg has been modified according to the invention. The rotation-proofing peg according to the invention has the same references as the peg of the prior art, to which 100 has been added.

Figure 5:
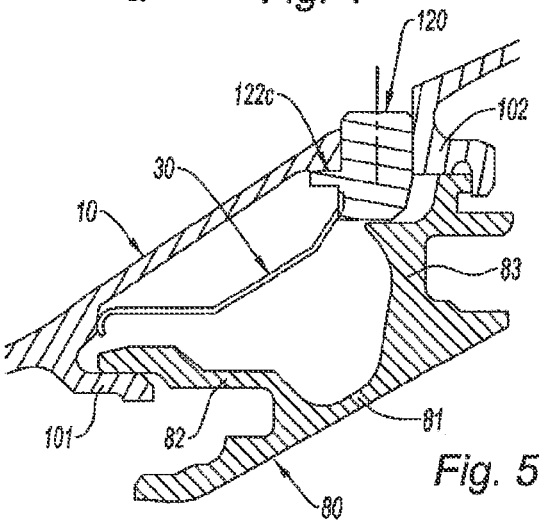
FIG. 5 is an axial sectional view corresponding to that in FIG. 2 with the modification of the invention.
Figure 6:
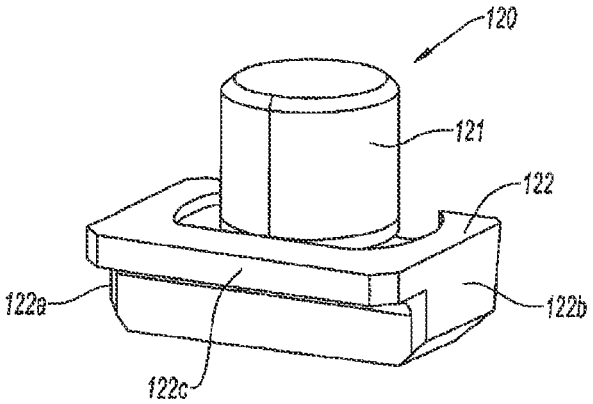
FIG. 6 shows the rotation-proofing peg of the invention.

Said peg 120 can be seen in FIGS. 5 and 6. It is similar to the peg 20 with a rod 121 and a head 122 and flanks 122*a* and 122*b*. The dimensions are the same as those of the peg 20. In addition, it comprises a lug 122*c* which extends at right angles to the axis of the rod 121 and over the width of the head 120. It is arranged between the rod and the head. Its thickness is calibrated.

FIG. 5 shows the new peg 120 in position. As the peg 20, it ensures the distributor is wedged against rotation with regard to the casing 10. It must be noted that, with regard to the prior art, only the peg has been modified. The other elements of the distributor, the sheet and the casing are the same. The tab bears against the upstream flank of the head 122 of the rotation-proofing peg. The lug 122*c* bearing against the casing forms a surface against which the downstream edge of the sheet is likely to abut. If friction arises during the operation of the turbo machine, the surface distorted by wear will be the surface of the lug 122*c* which is turned toward the inside; to be repaired, it will be sufficient where necessary to replace the peg 120 without having to strengthen the inside wall of the casing. The cost of the repair will be greatly reduced by this.

For preventive purposes, it is possible when the machine is visited to replace the existing rotation-proofing pegs 20 by the pegs 120 of the invention. The anti-rotation function is assured in the same way with, in addition, protection of the inside wall of the casing.

The invention claimed is:

1. A turbo machine including a device preventing rotation of a segment of a distributor in a form of a ring sector housed inside a ring-shaped casing of the turbo machine, the ring sector including fixed blades integral with a section of the ring sector, with interposing of a heat shield sheet between an inside wall of the casing and an outside wall of the distributor segment, comprising:

a rotation-proofing peg mounted both in a notch provided on the distributor segment at a radially inner end of the peg and a housing arranged on the casing at a radially outer end of the peg, the heat shield sheet including, at a downstream end, a tab bearing against the rotation-proofing peg; and a surface portion arranged radially between the tab and the inside wall of the casing, the surface portion forming an abutment in event of possible radial displacement of the heat shield sheet during operation of the turbo machine, wherein an upper surface of the surface portion bears against the inside wall of the casing, and an upstream facing end of the surface portion is free of contact with the casing.

2. The turbo machine as claimed in claim 1, wherein the rotation-proofing peg includes a head housed in the notch of the distributor segment and a rod entering the housing arranged on the casing, the surface portion being integral with the head of the rotation-proofing peg.

3. The turbo machine as claimed in claim 2, wherein the surface portion includes a shoulder machined in the head of the rotation-proofing peg.

4. The turbo machine as claimed in claim 1, wherein the surface portion is formed by a lug parallel to the axis of the distributor and bearing against the inside wall of the casing.

5. The turbo machine as claimed in claim 1, wherein the distributor segment includes a rib at right angles to the axis of the distributor and bearing against the inside wall of the casing, the notch of which is formed in a protrusion provided on one side of the rib.

6. The turbo machine as claimed in claim 5, wherein the heat shield sheet is in a form of a ring sector with an indentation corresponding to the protrusion, the tab being arranged in a bottom of the indentation.

7. The turbo machine as claimed in claim 5, wherein the shield sheet is provided upstream with regard to the rib of the distributor segment and the rotation-proofing peg.

8. The turbo machine as claimed in claim 1, wherein an axial length between the upstream facing end of the surface portion and a head of the rotating-proofing peg is less than an axial thickness of a rod of the rotating-proofing peg.

9. A turbo machine including a device preventing rotation of a segment of a distributor in a form of a ring sector housed inside a ring-shaped casing of the turbo machine, the ring sector including fixed blades integral with a section of the ring sector, with interposing of a heat shield sheet between an inside wall of the casing and an outside wall of the distributor segment, comprising:

a rotation-proofing peg mounted both in a notch provided on the distributor segment at a radially inner end of the peg and a housing arranged on the casing at a radially outer end of the peg, the heat shield sheet including, at a downstream end; a tab bearing against the rotation-proofing peg; and a surface portion arranged radially between the tab and the inside wall of the casing, the surface portion forming an abutment in event of possible radial displacement of the heat shield sheet during operation of the turbo machine, wherein an upper surface of the surface portion bears against the inside wall of the casing, and an upstream facing end of the surface portion is free of contact with the casing, and wherein an axial length between the upstream facing end of the surface portion and a head of the rotating-proofing peg is less than an axial thickness of a rod of the rotating-proofing peg.

10. A rotating-proofing peg in combination with a turbo machine including a device preventing rotation of a segment of a distributor in a form of a ring sector housed inside a ring-shaped casing of the turbo machine, the ring sector including fixed blades integral with a section of the ring sector, with interposing of a heat shield sheet between an inside wall of the casing and an outside wall of the distributor segment, the turbo machine comprising the rotation-proofing peg mounted both in a notch provided on the distributor segment at a radially inner end of the peg and a housing arranged on the casing at a radially outer end of the peg, the heat shield sheet including, at a downstream end, a tab bearing against the rotation-proofing peg; and a surface portion arranged radially between the tab and the inside wall of the casing, the surface portion forming an abutment in event of possible radial displacement of the heat shield sheet during operation of the turbo machine, wherein an upper surface of the surface portion bears against the inside wall of the casing, and an upstream facing end of the surface portion is free of contact with the casing, wherein the rotation-proofing peg includes a straight rod and a head with a first face parallel to the axis of the rod and a surface portion at right angles with respect to the first face on a side opposite the rod.

11. The peg as claimed in claim 10, wherein the peg includes a lug at right angles with respect to the axis of the straight rod, the surface portion being formed by the lug.

* * * * *